US005372288A

United States Patent [19]

Rogers et al.

[11] Patent Number: 5,372,288

[45] Date of Patent: Dec. 13, 1994

[54] ADJUSTABLE HANDGUN HOLSTER

[75] Inventors: William H. Rogers; Norman E. Clifton, Jr., both of Jacksonville, Fla.

[73] Assignee: Safariland Ltd., Inc., Ontario, Calif.

[21] Appl. No.: 176,765

[22] Filed: Jan. 5, 1994

[51] Int. Cl.[5] ..... F41C 33/02

[52] U.S. Cl. ..... 224/198; 224/243; 224/253; 224/222; 224/267; 224/912

[58] Field of Search ..... 224/191-193, 224/195-198, 200, 222, 224-226, 242-244, 253, 267, 911, 912; 248/283, 285

[56] References Cited

U.S. PATENT DOCUMENTS

| | | | |
|---|---|---|---|
| 1,037,717 | 9/1912 | Audley | 224/198 |
| 1,795,296 | 3/1931 | Zeng | 248/285 |
| 2,048,612 | 7/1936 | Maguire | 248/285 X |
| 2,708,537 | 5/1955 | Dec | 224/196 |
| 2,764,326 | 9/1956 | Stanton | 224/912 X |
| 4,029,242 | 6/1977 | Stoesser | 224/222 |
| 4,953,767 | 9/1990 | Bennett | 224/192 |
| 5,215,238 | 6/1993 | Baruch | 224/243 |
| 5,265,781 | 11/1993 | Nichols | 224/198 |

FOREIGN PATENT DOCUMENTS

| | | | |
|---|---|---|---|
| 0574196 | 4/1933 | Germany | 224/197 |

*Primary Examiner*—J. Casimer Jacyna
*Attorney, Agent, or Firm*—Arthur G. Yeager

[57] ABSTRACT

Handgun holster attached to a vertical support rod parallel to and spaced apart from the holster. There also is attached to the rod an arcuate strap as an upper body rest and a pad as a lower thigh rest, each rest being adjustable and clampable to selected positions for the convenience of the wearer. Preferably, this holster is for use in sports competition, where it is important to be able to draw quickly and fire.

20 Claims, 5 Drawing Sheets

ADJUSTABLE HANDGUN HOLSTER

BACKGROUND OF THE INVENTION

This invention relates to an adjustable holster for a handgun, revolver or pistol.

There have been known in the past holsters that are adjustable have been known in the past holsters that are adjustable to various selected angles and positions on the upper leg of wearer for quick draw purposes. Typical of such is that described in U.S. Pat. No. 5,167,355 to Hill involving a ratchet means to rotate tile holster to any angle about a fender which attached to a waist belt. This patented holster, however, does not permit other adjustments, e.g., vertical and rotational, which may well be necessary to reach the most desirable position for the holster for any unique individual.

Accordingly, it is an object of this invention to provide a holster that is adjustable in several directions. It is another object to provide a holster that is adjustable lengthwise of and rotationwise about, a vertical support rod. Still other objects will become apparent from the more detailed description of the invention which follows.

BRIEF SUMMARY OF THE INVENTION

This invention relates to a holster assembly for a handgun where the holster has two sidewalls, a back wall, an open front, an open top and an open bottom. This holster is longitudinally and rotatably attached to an elongated substantially vertical support rod closely spaced inwardly from the holster. An arcuate strap serving as an upper body rest is adjustably attached to the upper end of the vertical rod, and a lower thigh rest is adjustably attached to a lower portion of the vertical rod.

In specific and preferred embodiments of the invention the upper body rest is an arcuate strap which rests against the body contours of the wearer, perhaps at the waist, the hip, or the upper thigh, and is tiltable through a limited angle. The lower thigh rest is a pad which can be adjusted longitudinally along the rod and can be adjusted rotationally around the rod.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
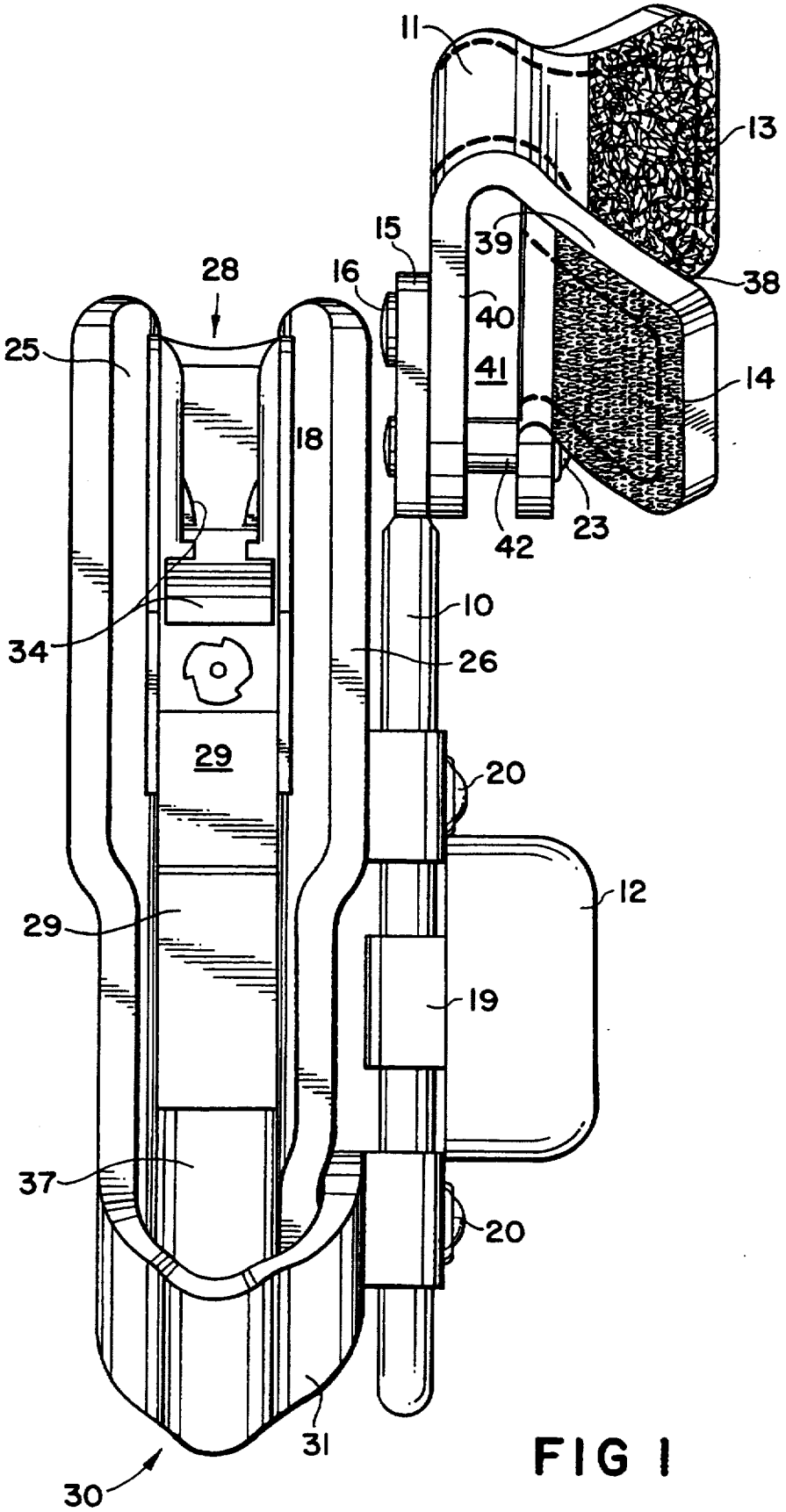
FIG. 1 is a front elevational view of the holster of this invention.
Figure 2:
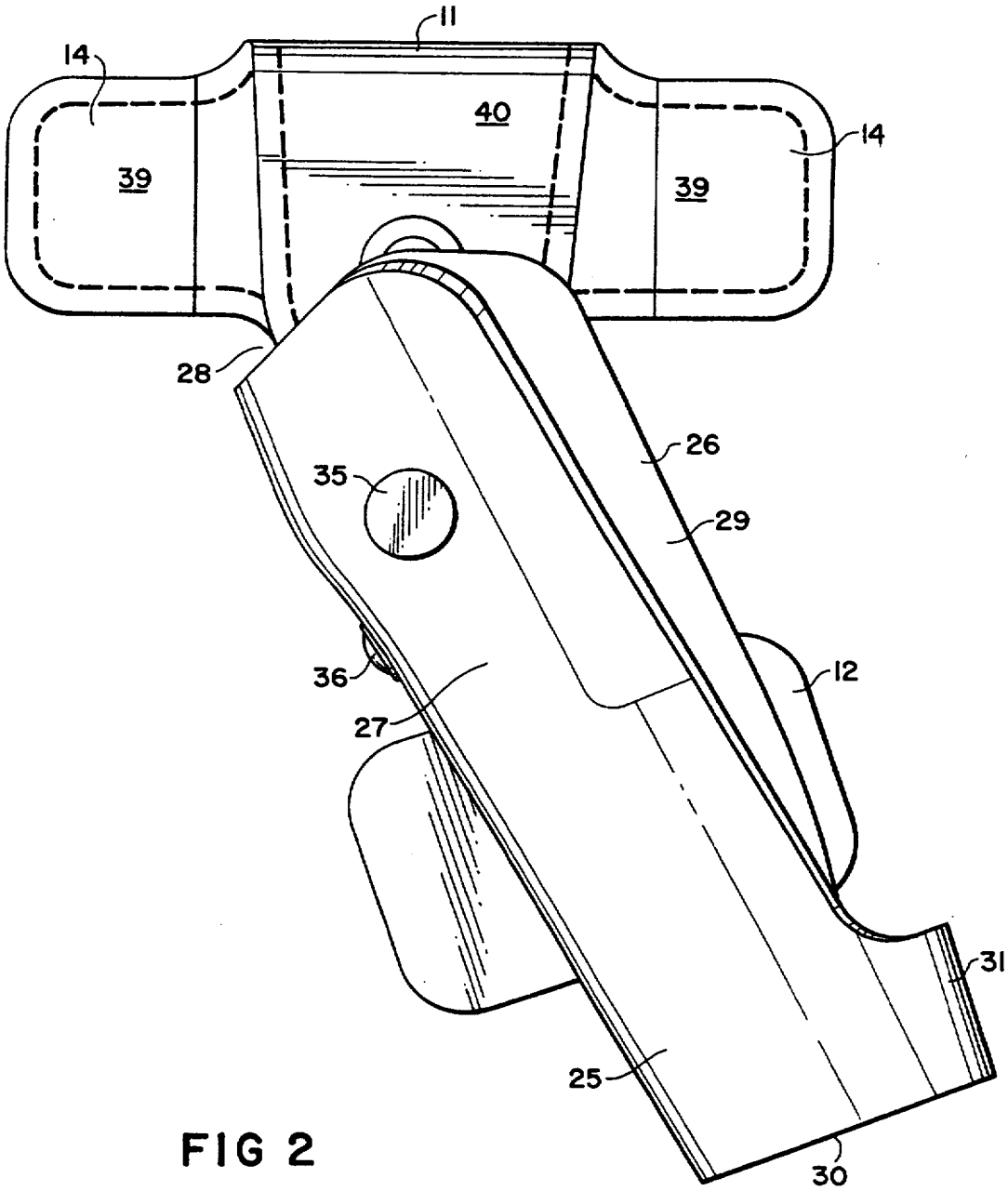
FIG. 2 is an outside elevational view of the holster of this invention.
Figure 3:
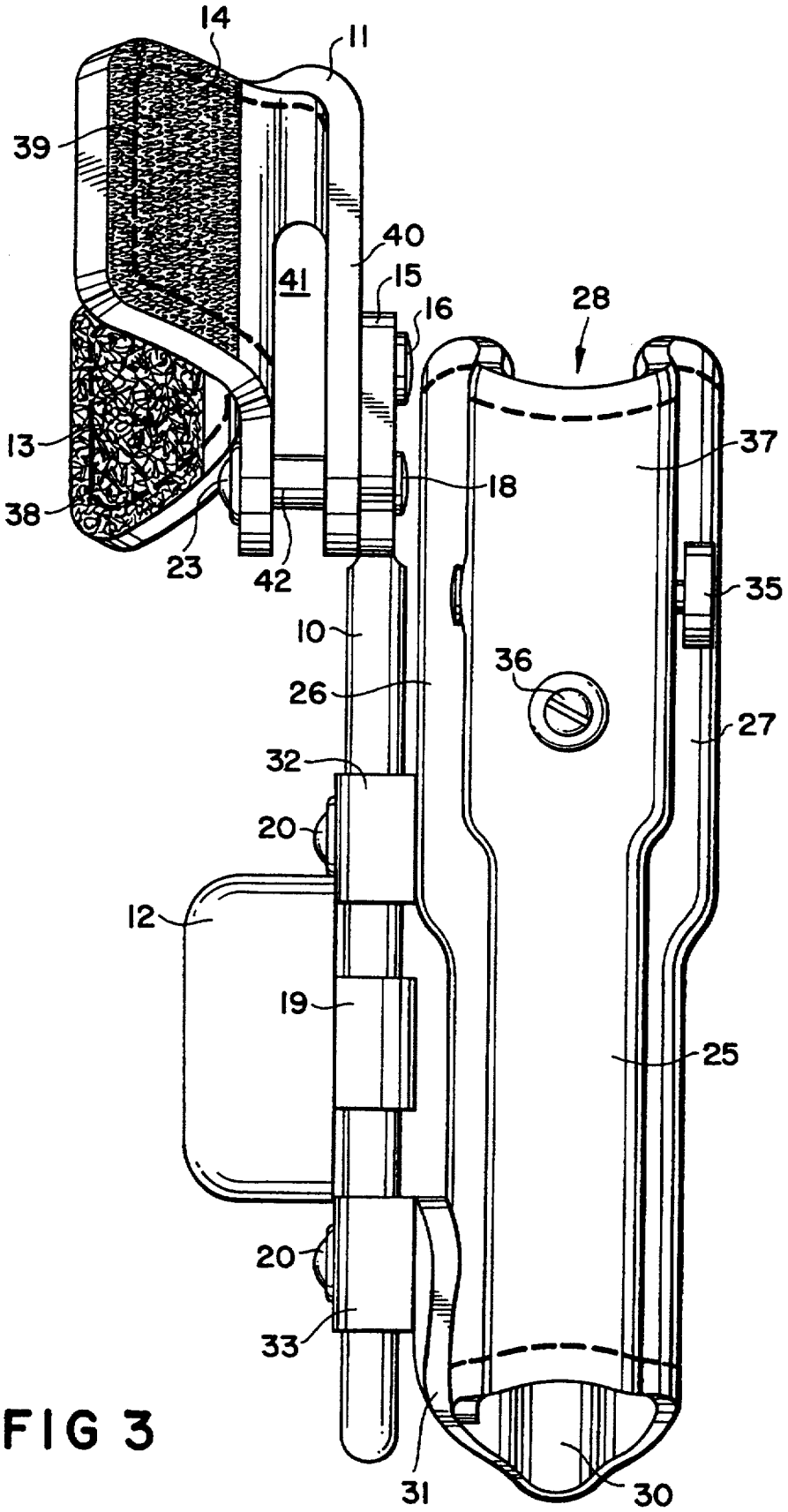
FIG. 3 is a rear elevational view of the holster of this invention.
Figure 6:
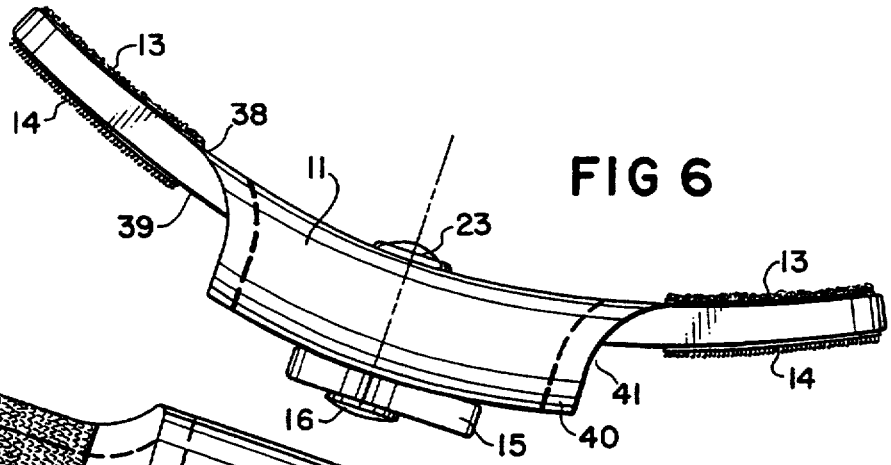
FIG. 6 is a top plan view of the assembly of FIG. 4.
Figure 4:
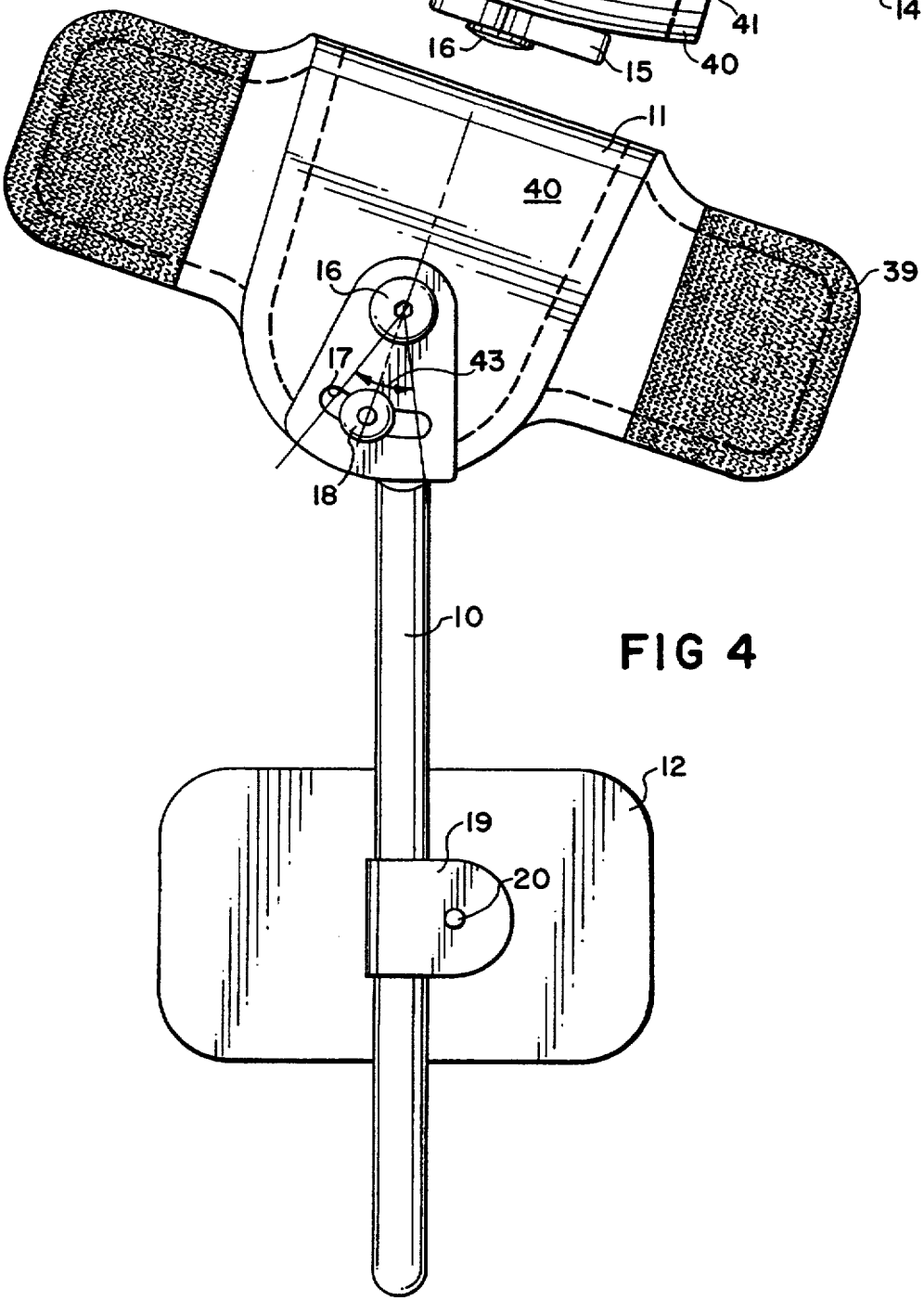
FIG. 4 is an outside elevational view of the assembly of the rod support, the upper body rest, and the lower thigh rest.
Figure 5:
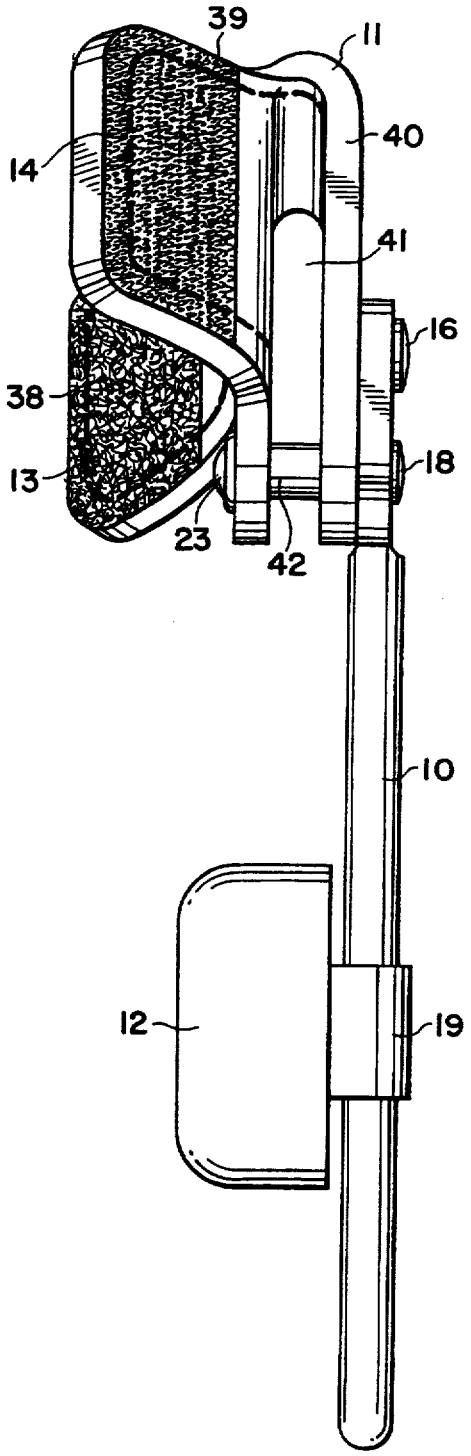
FIG. 5 is a rear elevational view of the assembly of FIG. 4.
Figure 7:
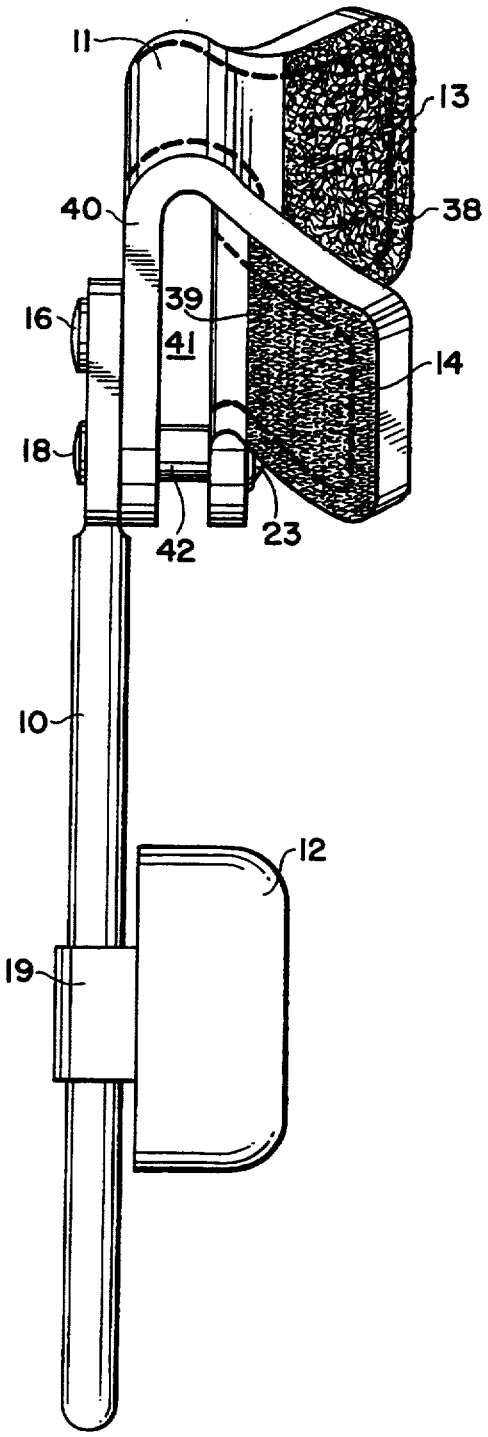
FIG. 7 is a front elevational view of the assembly of FIG. 4.

The advantages and operational features of this invention are best appreciated by reading the following description referring to the attached drawings.

The holster assembly of this invention includes as principal Components the handgun holster 25, the vertical rod support 10, the upper body rest 11, and the lower thigh rest 12. These components are adjustably fastened together so as to permit the precise positioning of the handgun grip where the wearer wants it for quick draw.

The holster 25 may be any of many styles none of which being critical to the operation of this invention. The holster 25 shown in these drawings is particularly adapted to competitive sports including activities involving quick draw and firing of a handgun. Holster 25 has an inside (adjacent the wearer's body) sidewall 26, an outside (spaced away from the wearer's body) sidewall 27, a back wall 37, an open top 28, an open front 29, an open bottom 30, and a muzzle strap 31. There also is included a trigger guard restraint mechanism 34 which adds retention to the weapon from rocking forward in the holster while providing an adjustable tension draw to the top of the holster and which preferably is included with the holster style shown in the drawings, but may be omitted with other styles of holsters. The details of the preferred trigger guard restraint are described and claimed in our U.S. Pat. No. 5,100,036 which issued Mar. 31, 1992. Outside screw 35 and rear screw 36 hold trigger guard restraint 34 in place in the interior cavity near open top 28 of holster 25.

Support rod 10 serves as a rigid spine to which all other components are attached in an adjustable manner. Rod 10 is a cylindrical rigid rod about the same length as holster 25 from top 28 to bottom 30. Rod 10 is spaced inwardly, i.e., toward the wearer's body, from holster sidewall 26 and positioned generally parallel to inside wall 26, and generally vertical in the same sense that holster 25 hangs vertically on the wearer's body. At the upper end of rod 10 there is a generally triangular flat head 15 to which upper body rest is attached. Holster 25 is attached to rod 10 by way of two spaced clamps 32 and 33. Lower thigh rest 12 is also attached to rod 10 by way of clamp 19, normally positioned between holster clamps 32 and 33. Clamps 19, 32 and 33 are generally similar in that they comprise two opposing jaws that wrap around rod 10 and are tightened together by a screw 20. When screw 20 is loosened it permits the component to which it is attached, e.g., holster 25 or thigh rest pad 12, to be moved slidably lengthwise of rod 10 or rotationally around rod 10. Thus, holster 25 and thigh rest pad 12 can be positioned to suit the wearer, and can be tightened in the desired position. Lower thigh rest pad 12 is merely a box like pad of suitable thickness to rest against the thigh of the wearer while preventing contact by other items, such as clamps 19, 32 33, screws 20, rod 10, etc. Rest 12 may be hard, soft, contoured, flat, or have any other desired characteristic. In the preferred embodiment as shown, rest 12 is a smooth hard, flat-surfaced pad.

At the upper end of rod 10 is head 15 to which upper body rest 11 is attached. Rest 11 is made with an interior concave surface 38 and an exterior convex surface 39 such that it resembles a curved or arcuate strap, the shape of the concave surface 38 being such that it fits the general contours of the body of the wearer where it rests. This may be at the waist, at the hip, or on the upper thigh of the wearer. A central portion of body rest 11 is formed into outer flap 40 which is folded downwardly and fastened with spacer 42, screw 23, and nut 18 to head 15. This arrangement leaves a tunnel space 41 to serve as a belt loop to receive a belt from which the holster is suspended. Head 15 is fashioned with an arcuate slot 17 through which screw 23 passes and this permits tilting of rest 11 with respect to rod 10 through angle 43, which may be about 300°-60°, preferably about 45°. Once the proper tilt has been reached body rest 11 can be fixed in place by tightening screw 23 against nut 18. Rest 11 pivots or tilts about screw 16 which is attached to head 15 and to flap 40, but does not extend through the concave-convex strap portion of rest 11.

As an added feature, which is not a critical portion of the invention, the strap portion of body rest 11 may be covered with pads of Velcro fastener in order to be more secure. It is a common practice for competition shooter's uniforms to include an underbelt and/or an overbelt of Velcro fastener material to be worn with handgun holsters. For this reason the drawings show pads of fabric loops 13 on concave surface 38 of body rest 11 and pads of fabric hooks 14 on convex surface 39 of body rest 11. These pads 13 and 14 can be fastened to an underbelt worn between body rest 11 and the body of the wearer, or they may be fastened to an overbelt threaded through loop 41 and worn around the body of the wearer. It is, of course, entirely optional to include or not to include pads 13 and 14 on body rest 11; since the holster assembly of this invention is entirely operational without pads 13 and 14.

It may be seen that the holster assembly of this invention permits the gun grip to be raised, lowered, or moved circumferentially about the thigh of the wearer. The adjustment of the positions of body rest. 11 and thigh rest 12 permit the handgun and holster to be positioned at different angles with respect to the thigh where the holster hangs.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to be secured by Letters Patent of the United States is:

1. A holster for a handgun, said holster having two sidewalls, a back, an open front, open top and open bottom, said holster being rotatably and longitudinally slidably attached to an elongated, substantially vertical support rod, an adjustable, arcuate upper body rest attached to the upper portion of said rod and a lower thigh rest pad rotatably and longitudinally slidably attached to the lower portion of said rod.

2. The holster of claim 1 wherein said upper body rest is an arcuate strap adapted to rest against the outside of the body of the wearer of the holder.

3. The holster of claim 2 wherein said strap has an inner surface partially covered by fabric loop fastener material and an outer surface partially covered by fabric hook fastener material.

4. The holster of claim 2 wherein said rod includes an arcuate slot engaged with a screw passing through said slot and said upper body rest to provide arcuate adjustment of said body rest with respect to said rod.

5. The holster of claim 1 wherein said holster is slidably attached to said rod by two spaced clamps each being separately clampable to said rod.

6. The holster of claim 3 wherein each said clamp comprises an opposing pair of jaws tightenable about said rod by screw means.

7. The holster of claim 1 which additionally includes on the inside of said back a trigger guard catch member adapted to assist in restraining said handgun in said holster.

8. A handgun holster releasably clamped to a substantially vertical support rod by two spaced clamps adapted to permit said holster to be slidably adjustable lengthwise and rotationwise about said rod; said rod being closely spaced inwardly from, and approximately coextensive with, said holster; an upper thigh rest including an arcuate strap adapted to rest against the outside contour of the body of the holster wearer and being angularly adjustably attached to the upper end of said rod; and a lower thigh rest pad adjustably clamped to said rod, spaced below said upper body rest; and being rotationally and longitudinally positionable with respect to said rod.

9. The holster of claim 8 having two sidewalls, a back wall, an open top, an open bottom and an open front.

10. The holster of claim 8 additionally including a trigger guard restraint mechanism mounted inside the holster and adapted to restrain forward rotation of a handgun in the holster while allowing rapid access in a vertical direction.

11. The holster of claim 8 wherein said rod has an upper end with an arcuate slot therein engaged with a clamping screw passing through said slot and through said upper body rest.

12. The holster of claim 8 wherein said upper body rest has an inside concave surface to which is affixed a pad of fabric loop fastener material and an outside convex surface to which is affixed a pad fabric hook fastener material.

13. A holster for a handgun, said holster having an inner and an outer sidewall, a back, an open top, a bottom, and a substantially open front extending from said top to adjacent said bottom, an elongated, substantially vertical support rod, means for rotatably and slidably attaching said inner side wall to said support rod, an adjustable upper body rest, means for attaching said upper body rest to an upper portion of said support rod, a lower thigh rest pad, and means for rotatably and longitudinally slidably attaching said pad to a lower portion of said rod.

14. The holster of claim 13 wherein said upper body rest is an arcuate strap adapted to conform to and rest against the outside of a body of a wearer of tile holster.

15. The holster of claim 13 wherein said means for rotatably and slidably attaching includes a pair of spaced clamps each being separately clampable to said rod.

16. The holster of claim 15 wherein each said clamp comprises an opposing pair of jaws tightenable about said rod by screw means.

17. The holster of claim 13 further including a catch member inwardly directed adjacent said back for assisting in restraining said handgun in said holster from forward movement.

18. The holster of claim 13 wherein said rod includes an enlarged upper plate, said upper plate having an arcuate slot extending generally laterally of a longitudinal axis of said rod, a bolt passing through said slot and said upper body rest to provide arcuate adjustment of said body rest with respect to said rod.

19. The holster of claim 13 wherein said upper body rest includes an inside concave surface, a pad of fabric loop releasable fastener material affixed to said inside concave surface, said body rest including an outside convex surface, a pad fabric hook releasable fastener material being affixed to said outside convex surface.

20. The holster of claim 13 wherein said bottom is open, further including means to restrain forward rocking of a handgun in the holster while allowing rapid access in a substantially vertical direction.

* * * * *